US008038451B2

(12) United States Patent
Peterson et al.

(10) Patent No.: US 8,038,451 B2
(45) Date of Patent: Oct. 18, 2011

(54) MULTI-BOARD PRINTED CIRCUIT ASSEMBLY HAVING ALIGNED CONNECTORS

(75) Inventors: Eric C. Peterson, McKinney, TX (US); Christian L. Belady, McKinney, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1335 days.

(21) Appl. No.: 11/283,199

(22) Filed: Nov. 18, 2005

(65) Prior Publication Data

US 2007/0117416 A1 May 24, 2007

(51) Int. Cl.
*H01R 12/00* (2006.01)

(52) U.S. Cl. ..... 439/65

(58) Field of Classification Search ..... 439/65, 439/64, 69, 377; 361/412, 413, 415, 424
See application file for complete search history.

(56) References Cited

U.S. PATENT DOCUMENTS

| | | | | | |
|---|---|---|---|---|---|
| 2,701,346 | A * | 2/1955 | Powell | 439/75 |
| 3,533,045 | A * | 10/1970 | Henschen | 439/62 |
| 4,220,382 | A * | 9/1980 | Ritchie et al. | 439/61 |
| 4,412,712 | A * | 11/1983 | Reimer et al. | 439/64 |
| 4,575,166 | A * | 3/1986 | Kasdagly et al. | 439/65 |
| 4,582,386 | A * | 4/1986 | Martens | 439/631 |
| 4,585,285 | A * | 4/1986 | Martens | 439/62 |
| 5,161,980 | A * | 11/1992 | Harner et al. | 439/65 |
| 5,238,423 | A * | 8/1993 | Hillis et al. | 439/259 |
| 5,430,615 | A * | 7/1995 | Keeth et al. | 361/788 |
| 5,648,891 | A * | 7/1997 | Gierut | 361/788 |
| 6,122,161 | A * | 9/2000 | Gierut | 361/683 |
| 6,425,767 | B1 * | 7/2002 | Lin | 439/65 |
| 6,464,510 | B1 * | 10/2002 | Len | 439/65 |
| 6,749,439 | B1 * | 6/2004 | Potter et al. | 439/65 |
| 6,781,845 | B2 * | 8/2004 | Chang | 361/736 |
| 2002/0182899 | A1 * | 12/2002 | Debord et al. | 439/65 |
| 2005/0052849 | A1 * | 3/2005 | Keating et al. | 361/719 |

* cited by examiner

*Primary Examiner* — Tulsidas C Patel
*Assistant Examiner* — Vladimir Imas

(57) ABSTRACT

A multi-board assembly includes a main printed circuit board (PCB) assembly that is coupled to at least two secondary PCB assemblies. A positioning device situates the second PCB assemblies in a desired position such that electrical connectors on the second PCB assemblies align with and engage complementary connectors on the main PCB assembly.

14 Claims, 6 Drawing Sheets

MULTI-BOARD PRINTED CIRCUIT ASSEMBLY HAVING ALIGNED CONNECTORS

BACKGROUND

Printed circuit boards (PCBs) are commonly used in the electronics industry in a variety of products, including computers, servers, and communication devices. Generally, an enclosure for an electronic product will include multiple PCBs which are coupled together using complementary electrical connectors. Such arrangements often include a PCB on which one or more electrical connectors are mounted that must align with one or more complementary connectors mounted on another PCB. When designing such an assembly, particular attention must be paid to PCB manufacturing tolerances which ultimately affect whether a connector on one board will properly align with a complementary connector on another board. Minimizing the effect of manufacturing tolerances has become increasingly difficult as technological advances have led to increases in the number and speed of signals carried by the electrical connectors, which, in turn, have resulted in connectors having smaller and more densely packed pins. Conventional manufacturing practices can hold positional tolerances for standard drilled holes on a PCB approximately in the range of to +/−2 mils to +/−5 mils. This tolerance range generally is sufficiently small to ensure that complementary connectors mounted on two separate PCBs will properly align and engage.

Problems with connector alignment arise, however, with board assemblies in which connectors on two or more boards must engage complementary connectors on another board (referred to herein as a multi-board assembly or arrangement). For instance, in multi-board arrangements having two boards that must couple to a single board, the stackup of manufacturing tolerances can result in hole-to-hole position variations between complementary connectors that are on the order of +/−20 to 30 mils. These large variations make the use of such multi-board arrangements impractical or impossible due to connector alignment problems. Unfortunately, a multi-board arrangement may not be avoidable in designs in which the circuit topology cannot fit on a printed circuit board that can be fabricated from a standard 18 inch×24 inch board panel. Although a printed circuit board can be manufactured from a larger panel, such a solution is undesirable due to increased manufacturing costs and the limited availability of manufacturers that can fabricate printed circuit boards from larger panels.

Accordingly, it would be advantageous to provide a multi-board printed circuit board arrangement that overcomes the problems arising from the stackup of manufacturing tolerances and ensures that the connectors mounted on the various PCBs are aligned for proper engagement.

DETAILED DESCRIPTION

Figure 1:
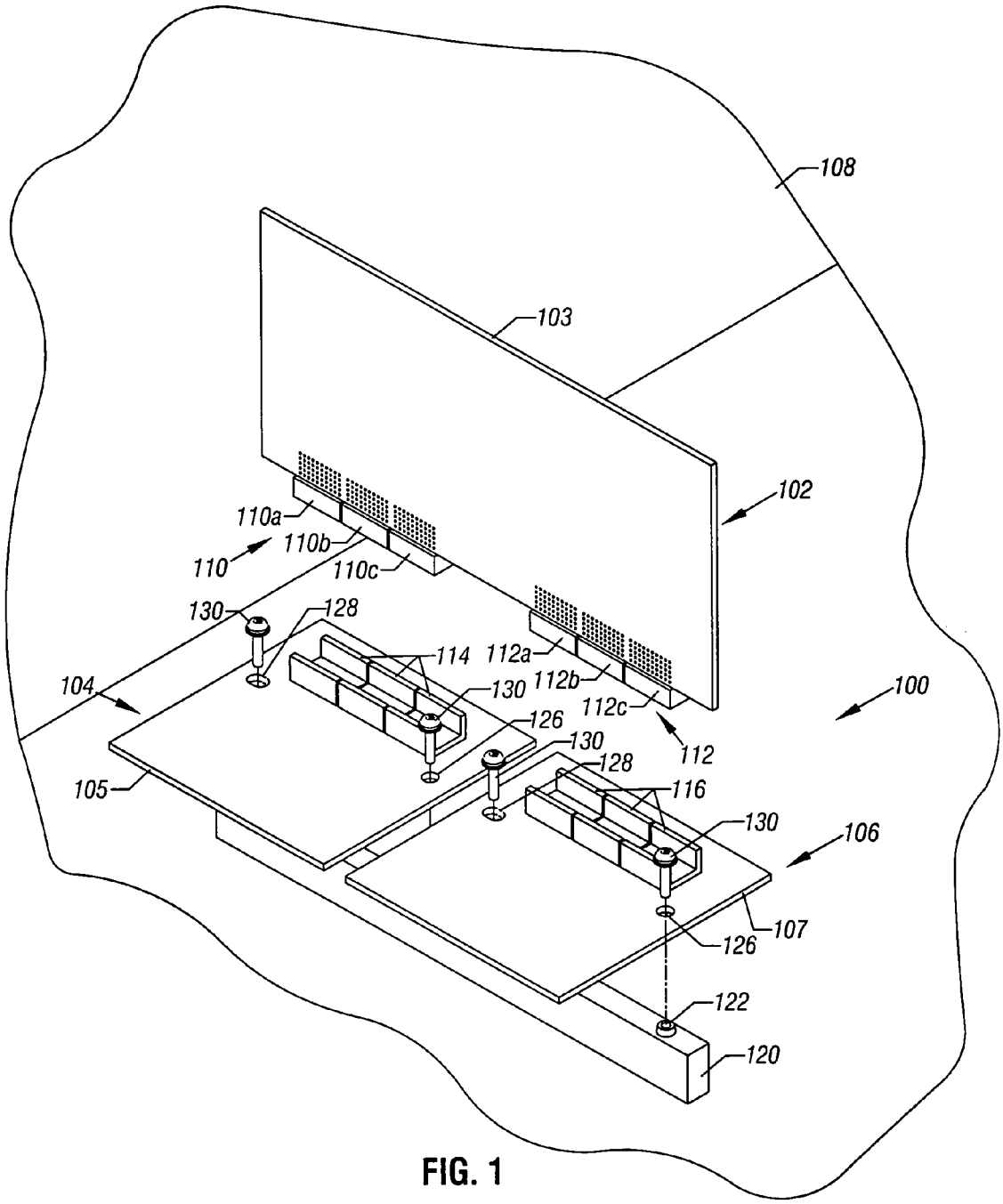
FIG. 1 is an exploded perspective view of a multi-board assembly in accordance with one embodiment of the invention.

FIG. 1 illustrates an example of a multi-board assembly 100 that includes a main printed circuit board (PCB) assembly 102 and two secondary PCB assemblies 104 and 106. Assemblies 102, 104, and 106 each include a PCB 103, 105, and 107, respectively, having a variety of electronic components (not shown) mounted thereon. PCB assemblies 102, 104, and 106 are generally configured to provide various functionalities for an electronic device, such as a computer system, server, or telecommunication device. Assembly 100 can be mounted in an enclosure 108 for such an electronic device in any suitable manner.

Main PCB assembly 102 also includes electrical connectors 110 and 112 mounted on PCB 103, which are configured to engage complementary connectors 114 and 116 mounted on PCBs 105 and 107, respectively. The electrical connectors 110 and 112 can be any type and configuration of electrical connector suitable for the particular application in which multi-board assembly 100 is used. Further, each of electrical connectors 110 and 112 can include multiple connector modules 110*a,b,c* and 112*a,b,c* (as shown). Alternatively, each connector 110 and 112 can be a single connector that engages complementary connectors 114 and 116, respectively, or connectors 110 and 112 can be integrated into a single connector body that is configured to engage with both complementary connectors 114 and 116. Connectors 110, 112, 114, and 116 can be mounted on PCBs 102, 104 and 106 in any suitable manner, such as with connector pins 118 (see FIG. 2A) that are soldered into or which engage plated-through holes in the PCBs 103, 105, and 107 with a press fit. In the embodiment shown in FIGS. 1 and 3, when connectors 110 and 112 engage connectors 114 and 116, respectively, main PCB assembly 102 is oriented in a plane P1 that is substantially perpendicular to a plane P2 in which secondary PCB assemblies 104 and 106 are positioned. However, other orientations of main PCB assembly 102 relative to secondary PCB assemblies also are contemplated.

To facilitate coupling of main PCB assembly 102 to secondary PCB assemblies 104 and 106 in a manner that ensures alignment and engagement of connectors 110 and 112 with connectors 114 and 116, multi-board assembly 100 includes a positioning device 120. In the embodiment illustrated in FIG. 1, positioning device 120 is configured as an elongate bar or strap that spans across and engages secondary PCB assemblies 104 and 106 in a manner that situates assemblies 104 and 106 in a desired position such that connectors 110 and 112 align with and engage complementary connectors 114 and 116, respectively, as will be explained in detail below.

Figure 2A:
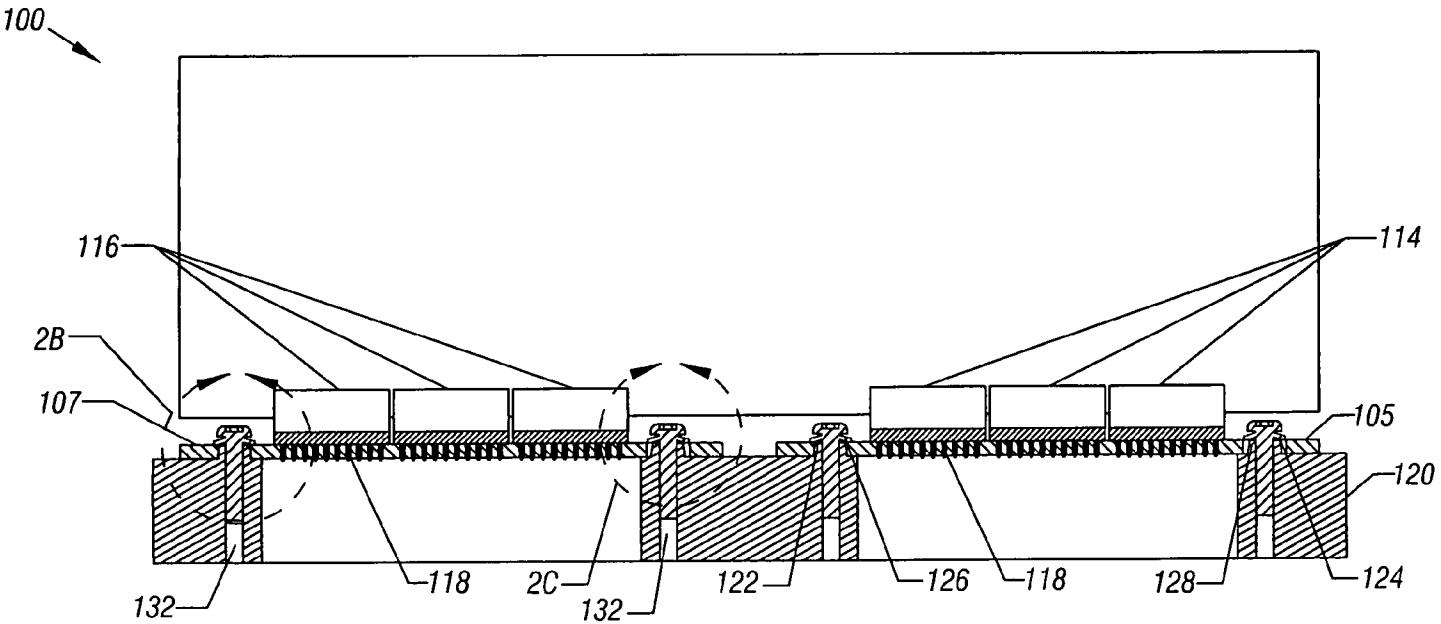
FIG. 2A is a cross-sectional view of the multi-board assembly shown in FIG. 3 taken generally along the line 2A-2A.
Figure 2C:
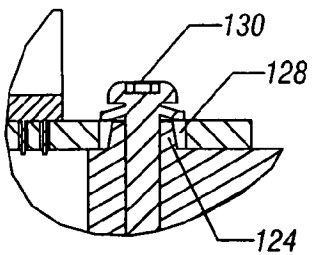
FIG. 2C is a partial close-up view of the multi-board assembly of FIG. 2A, taken generally in the area designated 2C.
Figure 2B:
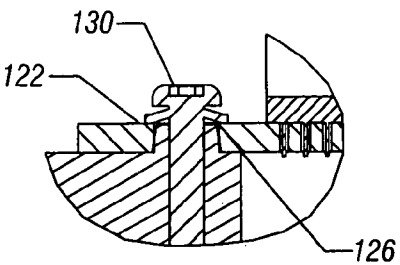
FIG. 2B is a partial close-up view of the multi-board assembly of FIG. 2A, taken in the area designated 2B.
Figure 3:
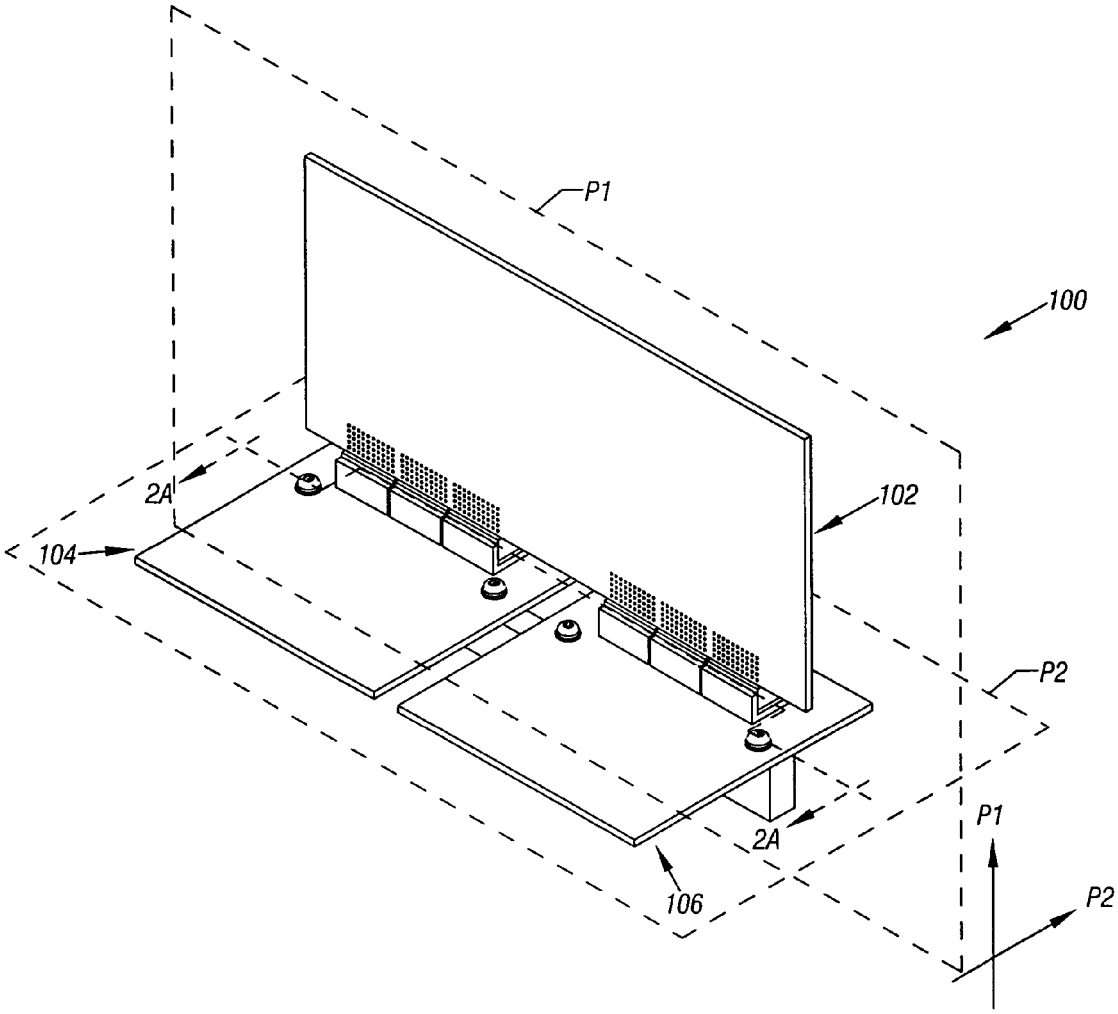
FIG. 3 is a perspective view of the multi-board assembly of FIG. 1, shown in its assembled state.

Referring now to FIGS. 2A, 2B, and 2C, positioning device 120 includes unique alignment features 122 and 124 that are configured as raised portions extending from a surface of device 120, and preferably are raised, tapered portions. Raised alignment features 122 and 124 are configured to engage complementary unique alignment features 126 and 128, respectively, provided in each PCB 105 and 107. In the example shown in FIGS. 1-3, complementary alignment features 126 and 128 are apertures which extend through each PCB 105 and 107. Complementary unique alignment feature 126 is a round-shaped hole, while complementary unique alignment feature 128 is a slot-shaped aperture. Round-shaped alignment features 126 in PCBs 105 and 107 provide for control of the location of PCBs 105 and 107 relative to each other within plane P2. Slot-shaped alignment features 128 provide for control of the rotation of each of PCBs 105 and 107 within plane P2.

As shown in the close-up details provided in FIGS. 2B and 2C, the taper and diameter of raised alignment features 122 are configured to provide for easy initial insertion into round-shaped features 126, and a final interference or press fit once the raised tapered feature 122 is fully inserted. As shown, alignment features 124 have the same configuration as features 122. However, features 124 can have any configuration suitable to engage slotted apertures 128. In other embodiments, alignment features 124 and complementary alignment features 128 can have other shapes or can be omitted.

Preferably, the complementary unique alignment feature 126 on PCB 105 is substantially the same as complementary unique alignment feature 126 on PCB 107. Likewise, complementary unique alignment feature 128 on PCB 105 is substantially the same as complementary unique alignment feature 128 on PCB 107. However, in some embodiments, PCB 105's complementary unique alignment feature 126 (or 128) can be configured differently than PCB 107's complementary unique alignment feature 126 (or 128), such that, for example, the positioning device 120 not only positions PCB 105 relative to PCB 107, but also keys the location of PCBs 105 and 107. In such embodiments, positioning device 120's alignment features 122 (or 124) each have a unique configuration that corresponds with the respective complementary alignment feature 126 (or 128).

Referring again to FIGS. 1-3, to retain secondary PCB assemblies 104 and 106 engaged to positioning device 120, as well as to provide a force to set the press fit between raised features 122 and alignment apertures 126, fasteners 130 can be provided. In the embodiment shown, fasteners 130 extend through apertures 126 and 128 in PCBs 105 and 107 and are received in openings 132 formed in raised features 122 and 124 and can be secured with, for example, a press fit or a threaded arrangement. Other suitable fastening arrangements also are contemplated.

Positioning device 120 with its alignment features 122 and 124 is manufactured in a manner that decreases the stackup of manufacturing tolerances that otherwise is present in multi-board assemblies, such that alignment between connectors 110 and 112 and complementary connectors 114 and 116 is achieved. For instance, in the embodiment shown in FIGS. 1-3, when device 120 is machined from a suitable material, such as steel, aluminum, or G10 epoxy board, or molded from a plastic material, the manufacturing tolerance stackup can be held to a delta tolerance between connectors 110 and 112 and complementary connectors 114 and 116 of less than 10 mils. In other embodiments, the tolerance stackup can be further reduced by locating the positioning device 120 on the same side of the boards 105 and 107 on which connectors 114 and 116 are mounted. Such a configuration eliminates the contribution the board thickness tolerance adds to the tolerance stackup.

Figure 4:
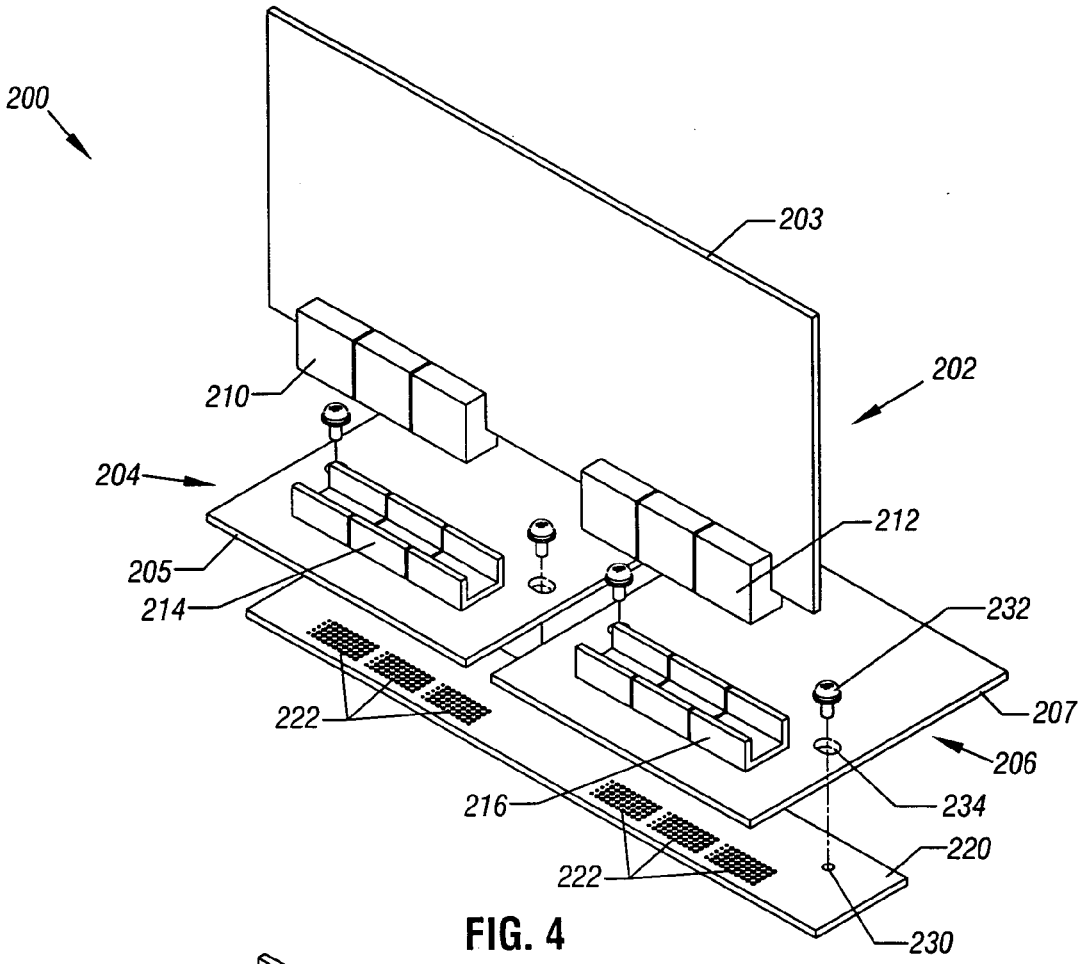
FIG. 4 is an exploded perspective view of a multi-board assembly in accordance with another embodiment of the invention.
Figure 5:
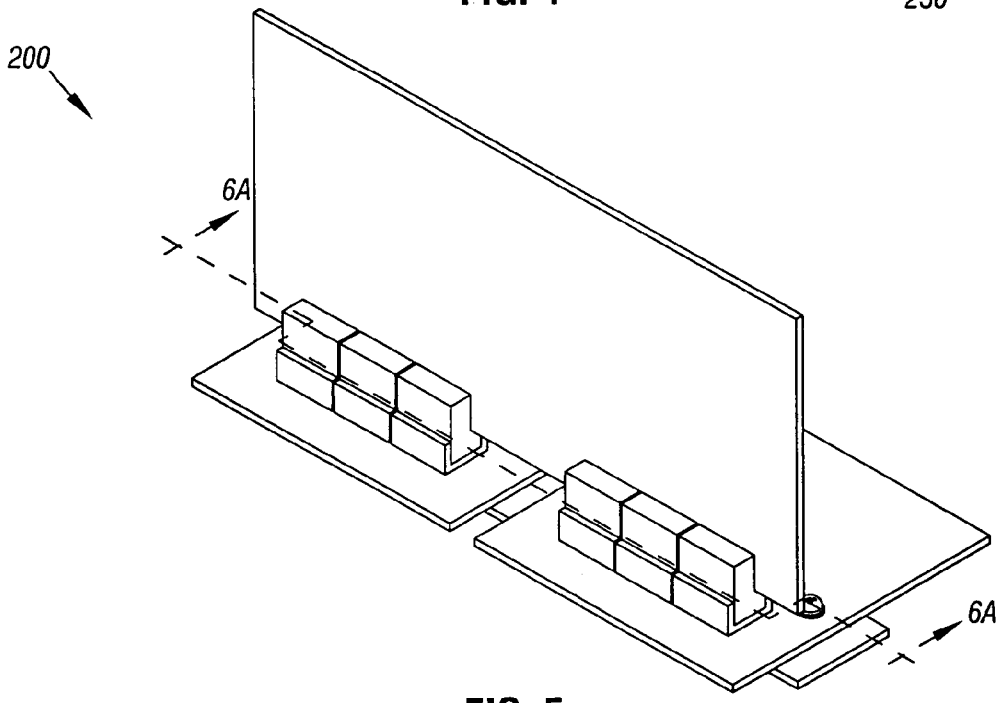
FIG. 5 is a perspective view of the multi-board assembly of FIG. 4, shown in its assembled state.

Turning now to FIGS. 4 and 5, another example of a multi-board assembly 200 is illustrated. Assembly 200 includes a main PCB assembly 202 and two secondary PCB assemblies 204 and 206. Assemblies 202, 204, and 206 each include a PCB 203, 205, and 207, respectively, having a variety of electronic components (not shown) mounted thereon. Main PCB assembly 202 further includes electrical connectors 210 and 212 mounted on PCB 203, which are configured to engage complementary connectors 214 and 216 mounted on PCBs 205 and 207, respectively. In this example, a positioning device 220 is configured as an elongate board or strap that spans across and engages secondary PCB assemblies 204 and 206 in a manner that ensures that connectors 210 and 212 align with and engage complementary connectors 214 and 216, respectively.

Figure 6A:
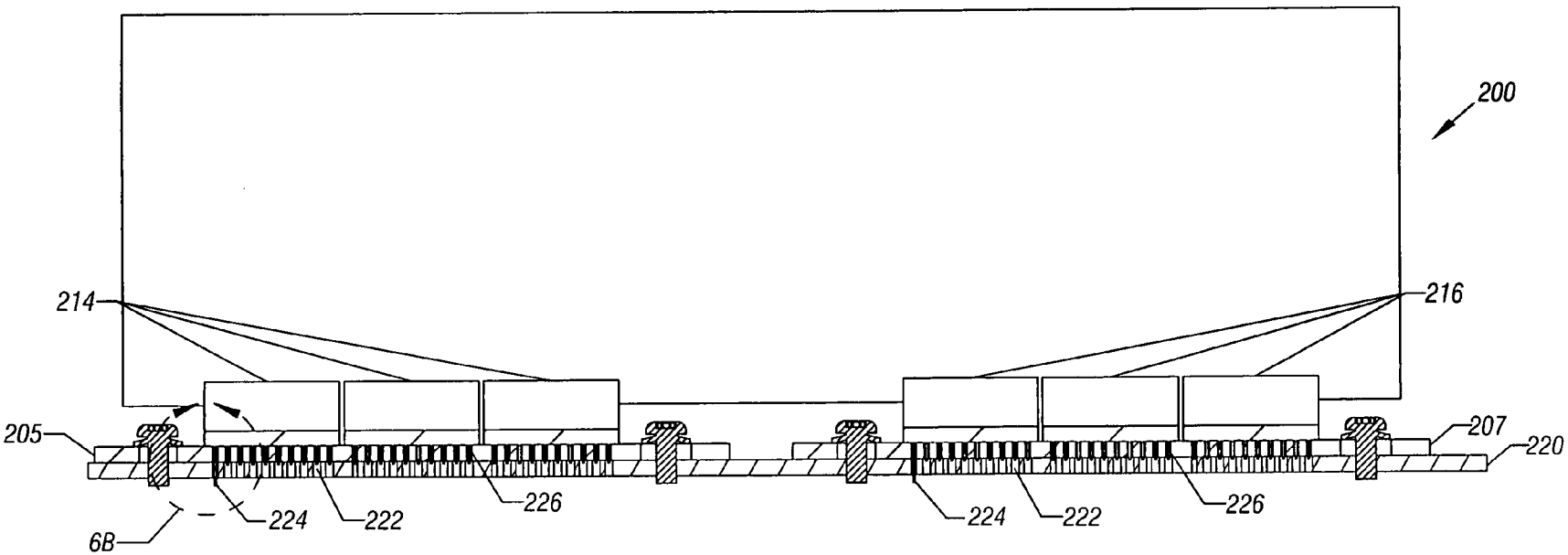
FIG. 6A is a cross-sectional view of the multi-board assembly of FIG. 5, taken generally along the line 6A-6A.
Figure 6B:
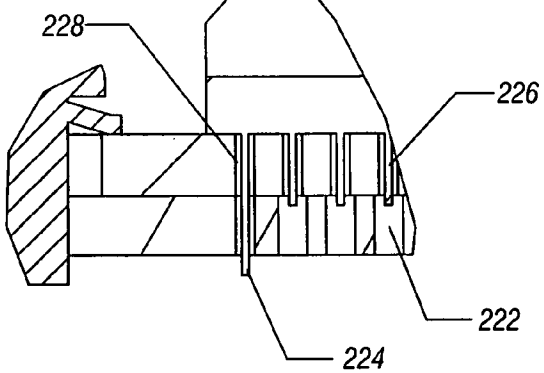
FIG. 6B is a close-up detail view of a portion of the multi-board assembly of FIG. 6A, taken generally in the area designated 6B.

Referring to FIGS. 4 and 6A, positioning device 220 includes unique alignment features 222 which are arranged to engage complementary alignment features 224 on secondary PCB assemblies 204 and 206. In this embodiment, alignment features 222 are apertures which extend through positioning board 220 and which are arranged in a pattern that matches the pin pattern of connectors 214 and 216. As shown in FIGS. 6A and 6B, each connector 214 and 216 includes a plurality of connector pins 226 extending from the underside of the body of connectors 214 and 216. Connectors 214 and 216 are mounted on PCBs 205 and 207, respectively, preferably with a press fit between pins 226 and connector pin apertures 228. Complementary alignment feature 224 in this embodiment is configured as a connector pin that extends from each of connectors 214 and 216 and has a length longer than the other connector pins 226. More specifically, complementary alignment pin 224 is configured such that it extends through an aperture 228 in each of boards 205 and 207 and further extends through and engages an alignment aperture 224 in positioning board 220 with a press fit. Alignment pins 224 also can engage apertures 228 with a press fit. Once positioning board 220 is engaged with secondary PCB assemblies 204 and 206, connectors 214 and 216 are registered relative to a single board, i.e., positioning board 220. Accordingly, this multi-board arrangement 220 emulates an assembly in which a main PCB assembly is coupled to a single secondary PCB assembly, resulting in a manufacturing tolerance stackup that is comparable to an arrangement in which connectors on a main PCB engage only with connectors on one other PCB.

Positioning board 220 can be made from the same type or similar material, e.g. G10 epoxy board, from which PCBs 205 and 207 are fabricated. Positioning board 220 can also include apertures 230 for receiving fasteners 232. Fasteners 232 extend through apertures 234 in PCBs 205 and 207 to securely couple positioning device 220 to PCB assemblies 204 and 206.

Figure 7:
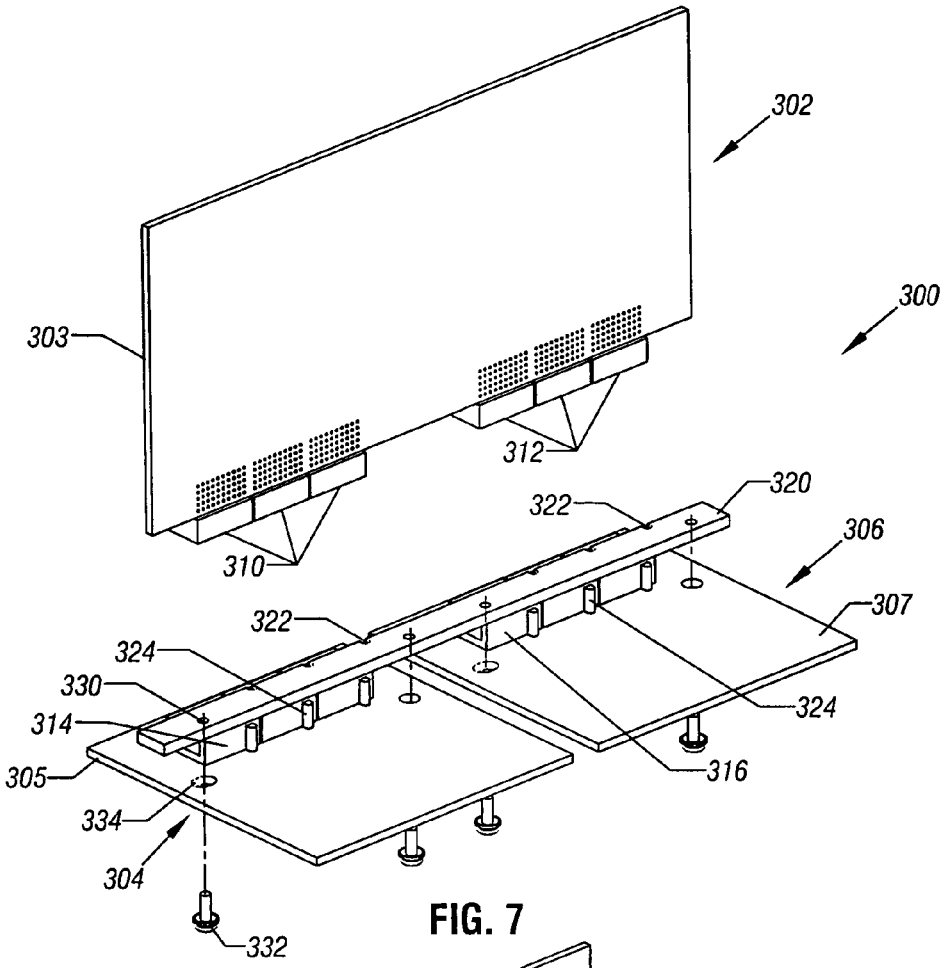
FIG. 7 is an exploded perspective view of a multi-board assembly in accordance with another embodiment of the invention.
Figure 8A:
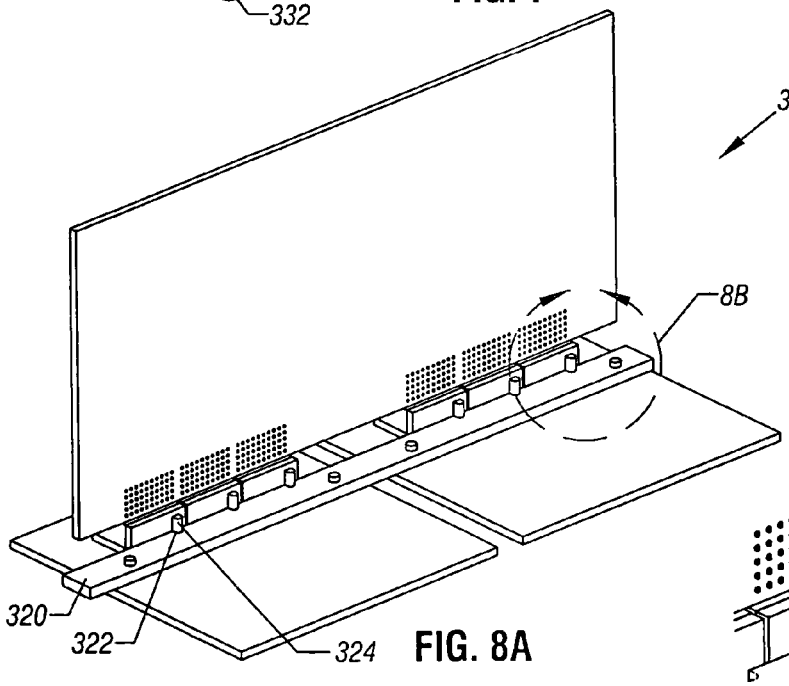
FIG. 8A is a perspective view of the multi-board assembly of FIG. 7, shown in its assembled state.
Figure 8B:
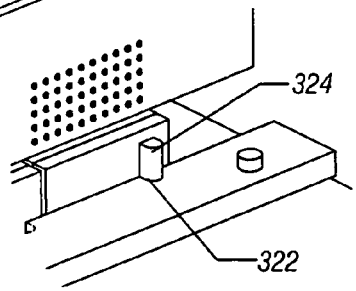
FIG. 8B is a close-up detail perspective view of a portion of the multi-board assembly of FIG. 8A, taken generally in the area designated 8B.

Referring now to FIGS. 7, 8A, and 8B, an example of a multi-board assembly 300 is illustrated. Assembly 300 includes a main PCB assembly 302 and two secondary PCB assemblies 304 and 306. Assemblies 302, 304, and 306 each include a PCB 303, 305, and 307, respectively, having a variety of electronic components (not shown) mounted thereon. Main PCB assembly 302 further includes electrical connectors 310 and 312 mounted on PCB 303, which are configured to engage complementary connectors 314 and 316 mounted on PCBs 305 and 307, respectively. In this example, a positioning device 320 is configured as an elongate bar, board, or strap that spans across and engages secondary PCB assemblies 304 and 306 in a manner that ensures that connectors 310 and 312 align with and engage complementary connectors 314 and 316, respectively.

In this embodiment, positioning device 320 includes unique alignment features 322 which are arranged to engage complementary unique alignment features 324 on secondary PCB assemblies 304 and 306. Specifically, positioning device 320 includes at least two alignment features 322 which are configured as recessed portions or notches formed in an edge of positioning device 320. The complementary alignment features 324 on secondary PCB assemblies 304 and 306 are provided by at least one raised portion extending from a surface of each of connectors 314 and 316. The raised alignment feature 324 can be an integral portion of the body of each of connectors 314 and 316 or can be attached to the connectors 314 and 316 by any suitable means. Further, the raised feature 324 can be configured as a rounded boss or rib, a triangular projection or any other shape suitable for cooperating with alignment notches 322 in positioning device 320. Still further, in some embodiments, raised feature 324 on connector 314 can have a different shape than raised feature 324 on connector 315. Alignment notches 322 can have any shape suitable to accept the complementary alignment features 324 on connectors 314 and 316, and further can be tapered to facilitate engagement with features 324.

Positioning device 320 can be machined out of any suitable material, such as steel, aluminum, or G10, or it can be molded from a plastic material. Positioning device 320 can further include apertures 330 which are arranged to accept fasteners 332 which extend through apertures 334 in each of boards 305 and 307 to more securely couple positioning device 320 to secondary board assemblies 304 and 306.

It should be understood that, in any of the embodiments shown and contemplated, the positioning device 120, 220, or 320 can be used as a tooling fixture that is removed after the main PCB assembly is coupled to the secondary PCB assemblies. Alternatively, the positioning device 120, 220, or 320 is a permanent part of the assembly 100, 200, or 300 which ultimately is placed in an enclosure for an electronic device. Further, in certain embodiments, it is contemplated that secondary PCB assemblies 104/106, 204/206, or 304/306 are configured to provide a backplane or a mid-plane in an electronic device, such as a computer system. In such embodiments, main PCB assembly 102, 202, or 302 can be configured as a daughter board.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A printed circuit board assembly, comprising:

at least two board assemblies, each board assembly including a printed circuit board having first and second opposing faces, an electrical connector having a plurality of contacts, and a first alignment feature;

a main board assembly including a main printed circuit board and a plurality of complementary electrical connectors, each complementary electrical connector having a plurality of complementary contacts; and a positioning device including a plurality of second alignment features, the second alignment features arranged to cooperate with the first alignment features to position the printed circuit boards such that one of the first and second opposing faces of each printed circuit board extends within a common plane and to establish a desired alignment of the electrical connectors, wherein the established desired alignment ensures that the plurality of contacts mates with the plurality of complementary contacts, wherein the first alignment feature comprises a raised portion extending from a surface of the respective electrical connector, and the plurality of second alignment features comprise a plurality of recessed portions formed in a surface of the positioning device.

2. A printed circuit board assembly, comprising:

at least two board assemblies, each board assembly including a printed circuit board having first and second opposing faces, an electrical connector having a plurality of contacts, and a first alignment feature;

a main board assembly including a main printed circuit board and a plurality of complementary electrical connectors, each complementary electrical connector having a plurality of complementary contacts; and a positioning device including a plurality of second alignment features, the second alignment features arranged to cooperate with the first alignment features to position the printed circuit boards such that one of the first and second opposing faces of each printed circuit board extends within a common plane and to establish a desired alignment of the electrical connectors, wherein the established desired alignment ensures that the plurality of contacts mates with the plurality of complementary contacts, wherein the first alignment feature comprises an elongated pin extending from the respective electrical connector, and the plurality of second alignment features comprise a plurality of alignment apertures extending through the positioning device.

3. The printed circuit board assembly as recited in claim 2, wherein the elongated pins engage the plurality of alignment apertures with a press fit.

4. An electronic device, comprising:

an enclosure; and a board assembly mounted within the enclosure, the board assembly comprising:

a first printed circuit board having a first mounting surface defining a first plane, the first printed circuit board having at least one electrical connector mounted thereon;

a plurality of second printed circuit boards, each of the second printed circuit boards having a second mounting surface, the plurality of second printed circuit boards arranged such that the second mounting surfaces together define a second plane substantially perpendicular to the first plane, each of the second printed circuit boards including a complementary electrical connector mounted thereon, the complementary electrical connector including a unique alignment feature; and a strap having a plurality of corresponding unique alignment features engaged with the unique alignment features of the complementary electrical connectors to position the second printed circuit boards in a desired location within the second plane to ensure that the complementary electrical connectors engage the at least one electrical connector.

5. The electronic device as recited in claim 4, wherein each of the unique alignment features comprises a raised portion extending from a surface of a respective complementary electrical connector, and the plurality of corresponding unique alignment features comprise a plurality of recessed portions formed in a surface of the strap.

6. The electronic device as recited in claim 4, wherein the unique alignment features comprise an elongated pin extending from a surface of each of the complementary electrical connectors, and the plurality of corresponding unique alignment features comprise a plurality of alignment apertures extending through the strap.

7. The electronic device as recited in claim 6, wherein the elongated pins engage the plurality of alignment apertures with a press fit.

8. A method of forming a printed circuit board assembly, comprising:

providing at least two printed circuit board assemblies, each having a printed circuit board, the printed circuit board having a component mounting surface;

mounting an electrical connector on the component mounting surface of each of the printed circuit boards, each electrical connector having a unique alignment feature;

providing a positioning strap having at least two corresponding unique alignment features; and engaging the at least two corresponding unique alignment features with the unique alignment features to position the component mounting surface of each of the printed circuit boards such that the component mounting surfaces together define a common plane and to establish a desired alignment of the electrical connectors.

9. The method as recited in claim 8, further comprising coupling a separate printed circuit board assembly to the at least two printed circuit board assemblies in a generally perpendicular orientation.

10. The method as recited in claim 9, further comprising disposing the separate printed circuit board assembly coupled to the at least two printed circuit board assemblies in an enclosure for a computer system.

11. The method as recited in claim 8, wherein each of the electrical connectors has an elongate pin extending from a surface of the electrical connector, the at least two corresponding unique alignment features comprise at least two alignment apertures extending through a surface of the strap, and the method further comprises:

extending the elongate pin of each of the electrical connectors through a corresponding aperture that extends through the component mounting surface of the respective printed circuit board thereby mounting the electrical connectors; and extending the elongate pins into the at least two alignment apertures.

12. A printed circuit board assembly, comprising:

a primary board assembly including a primary printed circuit board and a plurality of electrical connectors mounted on the primary printed circuit board;

at least two secondary board assemblies, each secondary board assembly including a secondary printed circuit board having first and second opposing faces, a complementary electrical connector disposed on one of the first and second opposing faces, and the complementary electrical connector including first means for aligning; and means for positioning the secondary printed circuit boards, the means for positioning including second means for aligning arranged to cooperate with the first means for aligning to establish a desired alignment of the complementary electrical connectors, such that the first opposing faces of the secondary printed circuit boards together define a common plane and the complementary electrical connectors are engageable with the plurality of electrical connectors.

13. The printed circuit board assembly as recited in claim 12, wherein the first means for aligning comprises a raised portion extending from a surface of the respective complementary electrical connector, and the second means for aligning comprises a plurality of recessed portions formed in a surface of the means for positioning.

14. The printed circuit board assembly as recited in claim 12, wherein the first means for aligning comprises an elongated pin extending from the respective complementary electrical connector, the second means for aligning comprises a plurality of apertures extending through a surface of the means for positioning.

* * * * *